US006612295B2

(12) United States Patent
Lerner

(10) Patent No.: US 6,612,295 B2
(45) Date of Patent: Sep. 2, 2003

(54) FUEL-AIR MIXER FOR ENGINE

(75) Inventor: Moshe Lerner, Ashdod (IL)

(73) Assignee: Greentech Motors Ltd., Tortola (VG)

( * ) Notice: Subject to any disclaimer, the term of this patent is extended or adjusted under 35 U.S.C. 154(b) by 0 days.

(21) Appl. No.: 09/836,040

(22) Filed: Apr. 17, 2001

(65) Prior Publication Data

US 2001/0050075 A1 Dec. 13, 2001

Related U.S. Application Data

(63) Continuation of application No. PCT/IL99/00552, filed on Oct. 21, 1999.

(30) Foreign Application Priority Data

Oct. 22, 1998 (IL) ..... 126708

(51) Int. Cl.[7] ..... F02M 29/04
(52) U.S. Cl. ..... 123/593
(58) Field of Search ..... 123/593, 1 A, 123/549

(56) References Cited

U.S. PATENT DOCUMENTS 4,088,103 A * 5/1978 Brown ..... 123/593
4,088,104 A * 5/1978 Ibbott ..... 123/593

* cited by examiner

*Primary Examiner*—Noah P. Kamen
*Assistant Examiner*—Hyder Ali
(74) *Attorney, Agent, or Firm*—Frommer Lawrence & Haug LLP; William S. Frommer; Matthew K. Ryan

(57) ABSTRACT

A fuel-air mixing device for installation preferably between an intake manifold and air intake duct of a cylinder of an internal combustion engine. The device extends downstream into the air intake duct, and has an open inlet end for channeling the air-fuel mixture into the device. A closed downstream end forces the air-fuel mixture to flow into the downstream end of the intake duct via special apertures which are adapted to atomise the fuel and mix the same with air. The arrangement ensures that the air-fuel mixture is urged towards the along the walls of the air intake duct, thereby vaporising the fuel by thermal contact therewith.

49 Claims, 10 Drawing Sheets

FUEL-AIR MIXER FOR ENGINE

This is a continuation of International Application PCT/IL/99/00552, filed Oct. 2, 1999.

TECHNICAL FIELD

The present invention relates to a device for providing an air/fuel mixture to a combustion chamber of an engine for combustion therein, in particular for providing such a mixture in which the fuel is vaporised and substantially homogeneously mixed with air. More particularly, the present invention relates to such a device having a system of specially configured screens for mixing the fuel vapour and air, and heating elements for vaporising the fuel.

BACKGROUND

In an internal combustion engine, a fuel/air mixture necessary for the combustion process the combustion chamber of each cylinder is provided typically by a fuel injection system or a carburetor upstream of or within the inlet manifold, the combustible mixture comprising droplets of fuel of differing sizes entrained in a stream of air As is well known, at relatively lower temperatures, fuel droplets tend to be of larger diameter and less homogeneously distributed in the air strewn than at relatively higher temperatures.

The fuel entry point (typically by way of the carburetor or fuel injector) is generally distanced from the intake port of each combustion chamber by a length of ducting, typically comprising one or more bends. This length of this ducting is generally such that the stream of air therein adopts a flow velocity profile such that fuel droplets carried with the air stream are urged to a central section of the ducting, and away from its walls, which are typically at an elevated temperature due to the normal running of the engine. In fact, no matter how well mixed and vaporised the fuel/air mixture may be when it leaves the carburetor or how well the fuel injector is configured to uniformly disperse the fuel in the air stream, by the time fuel/air mixture reaches the intake manifold, and particularly the air intake duct just upstream of the air inlet port to the cylinder, its characteristics will have changed. Typically, the fuel droplets, being distanced away from the hot walls, are kept relatively cool inhibiting full fuel vaporisation, and further, the effect of the air stream enhances coagulation of droplets into larger droplets. The result is that the fuel/air mixture reaching the combustion chamber comprises a substantially fuel-rich centrally flowing portion comprising a high proportion of fuel droplets that cannot combust rapidly enough when ignited because of their relatively large size and poor availability of oxygen due to non-homogeneous mixing of the air and fuel. The higher the engine rpm, the greater the tendency for the fuel to ingrate to the center of the air stream.

Thus, a proportion of the fuel, typically between 10% and 30% or even higher, is not properly utilised by the engine for generating power, and remains unburnt, being transformed instead into pollutants that are discharged into the atmosphere, requiring expensive catalytic converters in the exhaust system for their neutralisation. Further, the incomplete combustion of the fuel also results in the formation of carbon deposits, reducing the service life of the ignition units, pistons, valves and the engine in general.

Numerous prior art devices attempt to increase fuel efficiency and reduce pollutants by increasing the vaporisation of the liquid fuel. Fuel vaporisation is achieved mechanically by passing fuel through rotating blades, past screens or swirl chambers. Alternatively, and in some cases additionally, heating devices are provided to vaporise the fuel. Examples of such devices are described in U.S. Pat. Nos. 4,108,953, 4,204,485, 5,666,929, 4,550,706 and 4,359,035. These devices variously employ a screen for mixing and in some cases also a heater for vaporising fuel, some devices being complex and expensive, while others are not suitable for retrofitting except with major modifications to the engine and/or engine bay. In any case, the devices are not very effective for a number of reasons. Firstly, the devices are generally located at the carburetor/intake manifold junction. As such, the fuel/air mixture still has some distance to cover before entering each combustion chamber, with the result that the fuel droplets still cool coagulate and are urged towards the center of the ducts. A further problem with such devices utilising heaters is that the heaters are not always able to fully vaporise the fuel—the heating elements are disposed generally perpendicular to the direction of flow of the fuel droplets, which are thus not urged to remain in contact with the heating element for long. Thus, the contact time between the fuel and heater tends to be very small limiting severely the extent of vaporisation possible. Mixing is enhanced in the devices by the use of mesh or perforated screens. However, as has been mentioned earlier, the effectiveness of such mixing is in inverse proportion to the distance between the screen and the combustion chamber. In U.S. Pat. No. 4,295,458 a perforated open-ended cone is provided for precipitating fuel droplets at high speed on the manifold wall. However a large proportion of the fuel/air mixture continues through the open end of the cone and remains unaffected. In some embodiments, an internal component such as a turn helps swirl this flow. In any case, the effects of the cone are short-lived due to its displacement from combustion chamber entry.

There is thus still the need for a fuel/air mixer that ensures that a homogeneous air/fuel mixture comprising the smallest possible particles of fuel reaches the combustion chamber with the goal of obtaining complete combustion.

Devices for enhancing engine performance by providing water in a fine mist state are known, for example as disclosed by U.S. Pat. Nos. 3,767,172 and 4,076,002. However, while improving engine performance, use of water injection in internal combustion engines has certain drawbacks including the formation of calcium and said deposits on the valves, pistons and spark plugs.

In a second aspect of the present invention, a medium such as acetic acid solution, particularly mixed with methanol, may be inducted into the engine in lieu of water, improving performance thereof, while aiding in the cleaning of the air inlet system, combustion chamber and exhaust system during running of the engine. The methanol improves the vaporisation characteristics of the acetic acid and also acts as an antifreeze agent. According to this aspect of the invention, an atomise is provided for ensuring a high degree of vaporisation of the medium is provided. The medium also helps to prevent preignition of the combustion mixture in the combustion chamber, and thus substantially cheaper fuel without the usual anti-knock additives may be used, further reducing the running costs of an engine incorporating the present invention.

It is therefore an aim of the present invention to provide a device which substantially overcomes the limitations of prior art fuel/air mixing devices.

In particular, it is an aim of the present invention to provide a fuel/air mixing device incorporating a liquid fuel vaporiser for enabling high levels of fuel efficiency and low levels of pollution to be achieved for an internal combustion engine by way of fill combustion of the fuel.

It is another aim of the present invention to provide such a device that is retrofitable within existing internal combustion engines, particularly with minimal or nominal modification thereof or of the surrounding area.

It is another aim of the present invention to provide such a device that is simple to install and to operate.

It is another aim of the present invention to provide such a device that is relatively simple mechanically and thus economic to produce as well as to maintain.

It is another aim of the present invention to provide such a device that incorporates an electrically heated element for vaporising the fuel.

It is another aim of the present invention to provide such a device that incorporates a unique perforated screen for directing the fuel/air mixture along duct walls upstream of the air inlet port.

SUMMARY OF INVENTION

According to a first aspect of the invention, there is provided a fuel-air mixing device for installation in the air intake system of an internal combustion engine, said device extending into an air intake duct of a cylinder of an internal combustion engine towards a downstream end of the said intake duct, said device comprising:—first screen means having an open upstream inlet end, a closed downstream end, and a screen extending between a periphery of said upstream end and a periphery of said downstream end and comprising a plurality of outlet apertures for providing fluid communication between an upstream end of the air intake system and said downstream end of said air intake duct, said apertures adapted for enhancing atomization of liquid fuel passing therethrough; and mounting means for mounting said screen means within said air intake duct.

In a second aspect of the invention, there is provided combustion stability means for use in conjunction with the fuel-air mixing device comprised in an internal combustion engine, for delivering an atomised medium to a combustion chamber comprised in said engine, said combustion stability means comprising:-a refillable reservoir for holding a volume of said medium; an atomising unit; and suitable first and second fluid lines for respectively providing fluid communication between said reservoir and said atomising unit, and between said atomising unit and said intake system of said engine.

DISCLOSURE OF INVENTION

The present invention is defined by the claims, the contents of which are to be read as included within the disclosure of the specification, and will now be described by way of example with reference to the accompanying Figures.

The relative positional terms "upstream" and "downstream", respectively designated (U) and (D) in the Figures, herein refer to directions generally away from and towards the air inlet port of a combustion chamber, respectively, unless otherwise specified.

The present invention relates to a device for mixing fuel and air prior to combustion thereof for an internal combustion engine. The following description, though directed at internal combustion engines operating on the Otto cycle, is also applicable to other internal combustion engines, mutatis mutandis.

Figure 1:
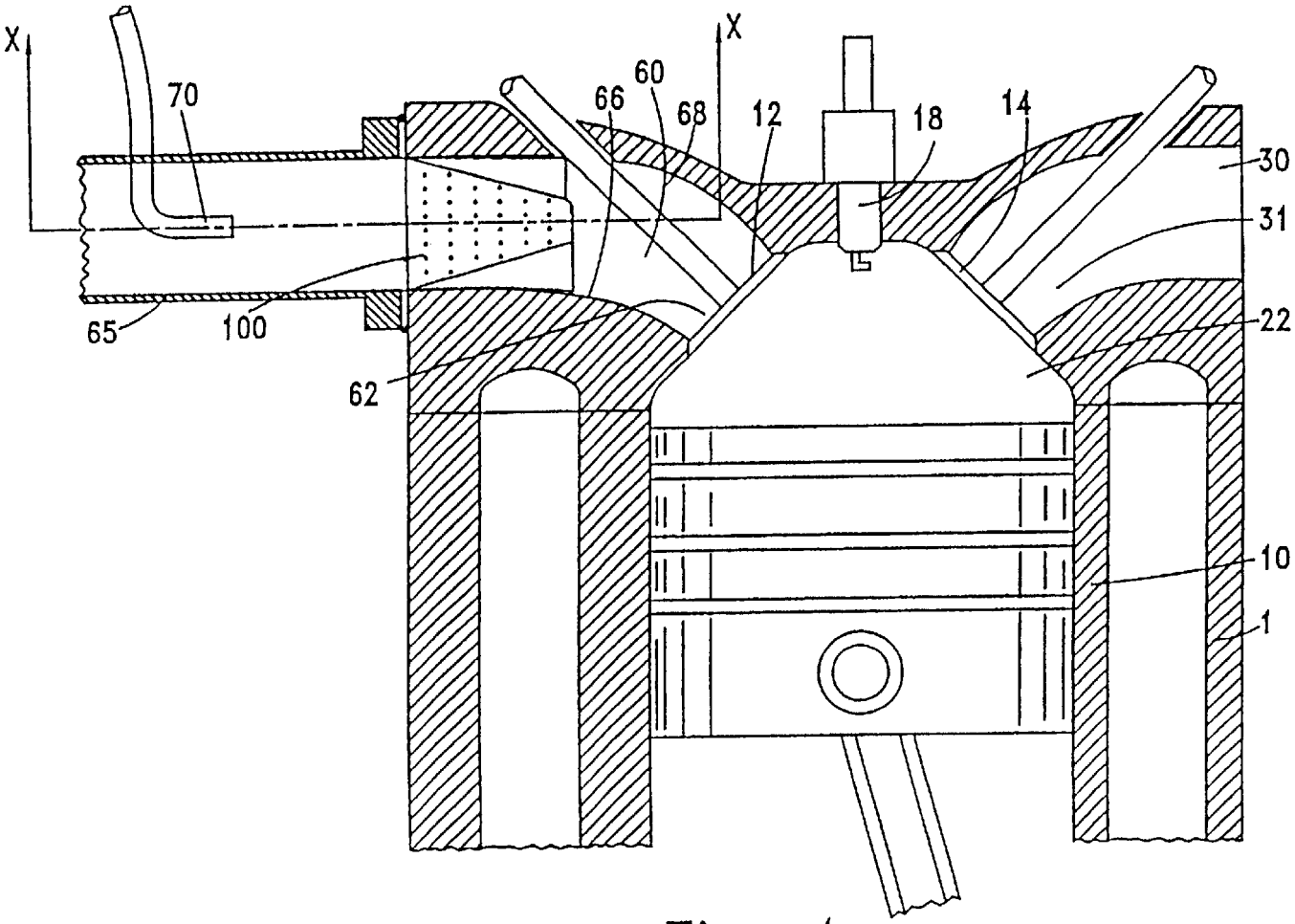
FIG. 1 illustrates the general layout of the air inlet and combustion system of an internal combustion engine comprising the present invention.

Referring to FIG. 1, a typical conventional internal combustion spark-ignition engine (1) comprises at least one cylinder (10) heaving an internal reciprocating piston (16) operatively connected to a crankshaft (not shown), and an upper combustion chamber (22).

Said cylinder (110) further comprises means for introducing air and fuel separately. The air inlet system of the engine (1) typically comprises an air inlet duct (60) and an intake manifold (65). The air inlet duct (60) is in fluid communication with an inlet port (62), having an inlet valve (12), and with an air supply, typically provided directly from the atmosphere via intake manifold (65). The air inlet duct (60) is typically comprised in the cylinder head of an engine (1) which is mounted onto the engine block thereof. Liquid fuel is provided by a fuel inlet pipe or injector (70) in fluid communication with the air inlet duct (60). Typically there is a separate fuel injector (70) for each cylinder (10) of the engine (1), located in the intake manifold (65). Alternatively, said cylinder (10) comprises means for introducing air and fuel which has been already premixed to some degree in a carburetor (19), for example, said means being in fluid communication with said air inlet duct (60) via said intake manifold (65) Said cylinder (10) further comprises means for exhausting the fluid contents of the cylinder after the power stroke, comprising an outlet duct (30) in fluid communication with an outlet port (31) in the combustion chamber (22) having an outlet valve (14). The said cylinder (10) further comprises igniter means (18) such as a spark plug or the like.

Most conventional internal combustion spark-ignition engines operate on a four-stroke cycle, though some engines work on a two-stroke cycle. On a typical four-stroke Otto cycle, the first—inlet—stroke consists of a downwards motion of the piston (16), the inlet valve (12) being synchronised to open and draw in an appropriate air/fuel mixture from a carburetor. Alternatively, if the engine comprises a fuel injector system, air is drawn into the combustion chamber (22) via the intake manifold (65) and air intake duct (60), and each fuel injector (70) introduces a predetermined amount of fuel according to predetermined parameters and at synchronised times. In the second stroke, also known as the compression stroke, the piston (16) moves upwards compressing the air/fuel into the combustion chamber (22). Typically, shortly before the piston reaches top dead center, the air/fuel mixture is ignited by the igniter means (18). Rapid combustion occurs, accompanied by the production of combustion gases having high temperature and pressure. In the third stroke, the power stroke, the high-pressure combustion gases force the piston (16) downwards, providing a rotary power output via the crankshaft. In the fourth—exhaust—stroke, the outlet valve (14) is synchronised to open, so that the combustion gases may flow out of the cylinder (10) as the piston (16) moves upwards to top dead center again to commence another cycle.

The timing and duration of the spark as well as the proportions of the air/fuel mixture are important parameters which vary with engine speed and load, and which have to be controlled carefully. Though mechanical systems have been used in the past for control, electronic microprocessors operatively connected to suitable file injection systems provide greater and more reliable control, and are known in the art.

The device of the present invention, generally designated (100) is directed at preparing an atomised fuel-air mixture by increasing the uniformity and degree of fuel-air mixing such that at the combustion stroke stoichiometric burning of the fuel may be substantially achieved, leading to increased fuel efficiency coupled with lower levels of pollutants.

Thus, the device (100) is installed in the air intake system of an internal combustion engine, and extends into the air intake duct (60) of a cylinder (10) towards a downstream end (68) of the said intake duct (60). At least one said cylinder (10), and preferably all the cylinders (10) of the engine (1), are equipped with said device (100) The device may be installed directly within the air intake duct (60) itself, when possible, but typically the device (100) is preferably installed between the intake manifold (65) and air intake duct (60) of a cylinder (10) of an internal combustion engine (1), such that the device extends as far as possible into said air intake duct towards a downstream end thereof. It is in fact a characterising feature of the present invention that the device (100) is installed just upstream of the air inlet port (62) of the combustion chamber. Thus, the fuel-air mixture resulting from flowing through the device (100) has relatively little time to cool and form fuel droplets, and less so for such droplets to coalesce into relatively larger particles and/or urged to the center of the inlet port (62).

Figure 11:
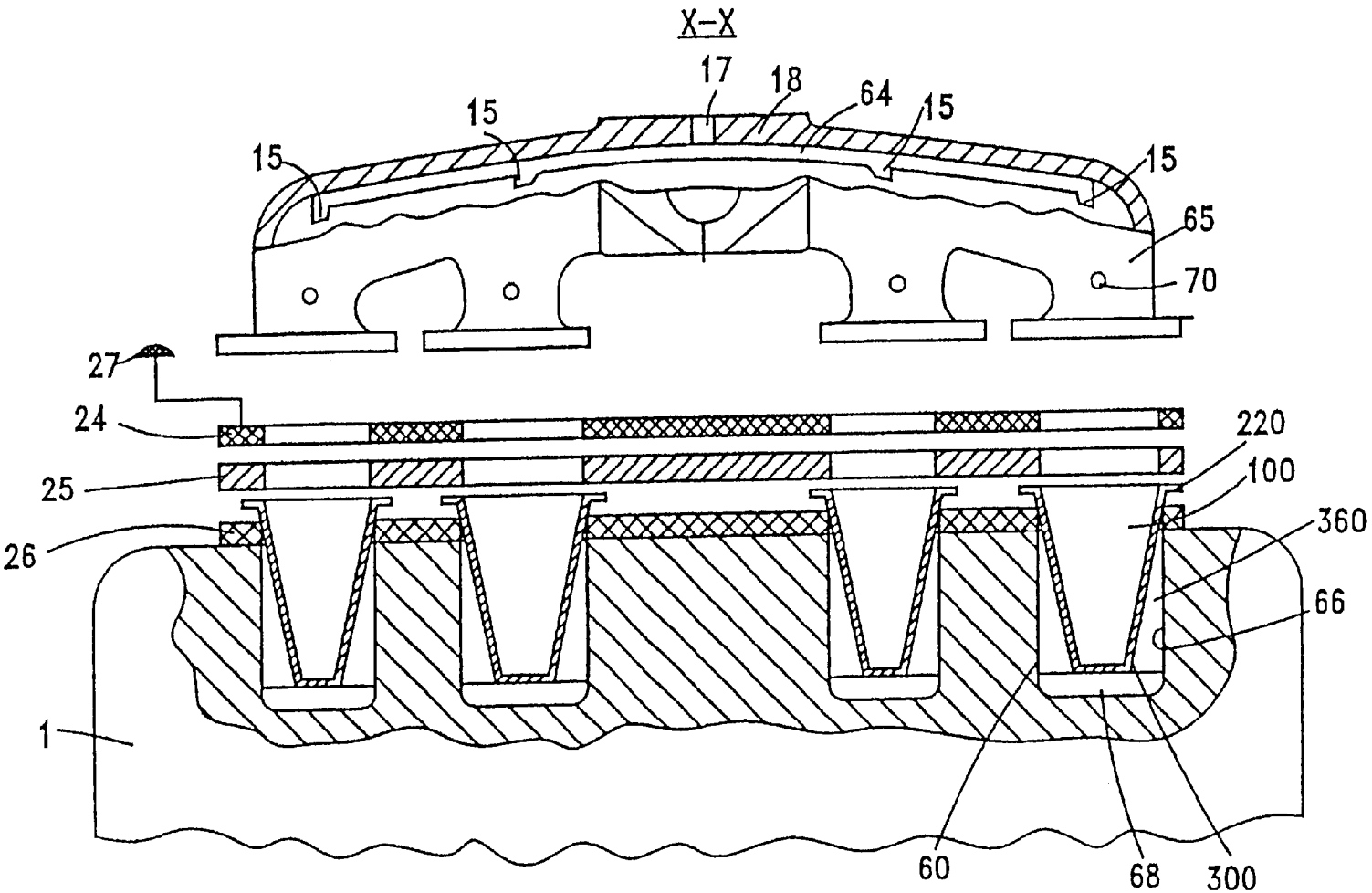
FIG. 11 illustrates in top partially sectioned view the engine of FIG. 11 along X—X.

In its simplest form, and referring to FIG. 11, the device (100) comprises first screen means (300) having an open upstream inlet end (310), a closed downstream end (340), and a screen member (330) extending between a periphery of said upstream end and a periphery of said downstream end, the first screen means comprising a plurality of outlet apertures (320) adapted for enhancing atomisation of liquid fuel passing therethrough, and providing fluid communication between the intake manifold (65) and the downstream end (68) of the air intake duct (60). At least some of said plurality of apertures are further adapted to direct fluid passing therethrough in a substantially downstream direction towards and substantially parallel to internal walls of said air intake duct opposite said apertures. The upstream inlet end (310) matches in profile, and is typically sealingly coupled with, the upstream end of the air inlet duct (60), such that all the fluid flow into the air inlet duct (60) from the intake manifold (65) is by way of the device (100) only. The screen means (300) may be regarded as a converting membrane means for preparing the air-fuel mixture prior to entry into the combustion chamber (22), in which fuel particles are broken Up into smaller particles and atomised, and thoroughly mixed with air, by passing therethrough. Fuel particles are then directed towards the internal surface (66) of intake duct (60), which may be optionally coated with a polished anti-static layer or with a solid lubricating layer, for vaporisation of the fuel due to thermal contact therewith. The device (100) further comprises mounting means for mounting the device within the said air intake duct (60), and preferably for mounting the said upstream end of said screen means between said intake manifold of the air intake system and the air intake duct. The mounting means preferably comprises a flange (220) joined to said device (100) and adapted for being seated intermediate said air intake duct (60) and said intake manifold (65) directly or via one or more gaskets. Preferably, the said flange (220) is joined to, preferably integrally with, the upstream end of the screen means (300), described further hereinbelow. Alternatively, the flange (220) is joined to the upstream end of a housing (200), described hereinbelow, to facilitate installation of the device (100) in the said air intake duct (60). The flange (220) is typically particularly thin, and may comprise a coating of suitable material to replace an existing gasket between the intake manifold and the air intake duct. Alternatively, the flanges (220) of a number of said devices (100) corresponding to two or more adjacent cylinders (10) of any particular engine (1) may also be joined to form an integral unit. Alternatively, the device (100) may be fitted in the air intake duct (60) such that the flange (220) is seated upstream or downstream of an existing gasket. Thus the device (100) of the present invention is readily retrofitable with respect to existing engines.

Optionally, the said intake manifold (65) may be sealingly mounted onto the engine (1) via a magnetic gasket (25) sandwiched between an upstream electrically insulating gasket (24) and flanges (220), which are aligned upstream of the engine's existing gasket (26). The magnetic gasket (25) comprises a terminal (27) and is in electrical contact with screen member (300) via flanges (220), and is provided for removing static electricity from the screen means (300).

In a preferred embodiment of the present invention, and referring to FIGS. 2 to 7, the device (100) comprises a housing (200) axially enclosing said screen means (300) and having an external profile substantially complementary to the internal surface (66) of at least portion of the air intake duct (60) extending downstream from the upstream end of the intake duct (60) such as to enable the housing (200) to be installed in the air intake duct (60) in a tight-fitting manner, the internal surface (210) of the housing (200) thereby substantially replacing a corresponding portion of the internal surface (66) of the air intake duct (60) as the fluid flow boundary. Thus, in the embodiment shown in FIGS. 2 and 3, the housing (200) is of a substantially box-like construction, having a substantially rectangular cross-section complementary to that of the air intake duct (60), and having open inlet and outlet ends, (205) and (215), respectively. Alternatively, the housing (200) may assume any other profile, for example tubular, fist-conical and so on, according to the particular physical characteristics of the air intake duct (60) of the internal combustion engine (1), and the present description is also applicable to such variations of profile of the housing (200) and of the air inlet duct (60), mutatis mutandis. The said housing (200) is typically made from a heat conductor such as thin copper or brass sheeting, for example between about 0.5 mm and 2.0 mm thickness, and advantageously optionally comprises a coating or layer of a polished anti-static material such as synthetic ceramics or silicone lacquers, for example, or solid lubricating material having good thermal conduction properties such as Teflon or the like, for example, on at least part of the internal surface (210) thereof.

Screen means (300) is accommodated within the housing (200). The screen means (300) is characterised in comprising an open upstream inlet end (310) and a closed downstream end (340), with a screen member (330) joining the periphery of the upstream inlet end (310) to the downstream end (340). The closed downstream end (340) of the screen means (300) is typically substantially perpendicular to the longitudinal axis of die air intake duct (60). The screen member (330) comprises a plurality of outlet apertures (320) for providing fluid communication between the intake manifold (65) and the downstream end (68) of the air intake duct. The upstream end (310) is adapted for channeling the fluid flow from the intake manifold (65), consisting of air with fuel in the form of vapor and droplets of varying sizes, into the volume bounded by the screen member (330) and the end plate (340), so that the fluid flow is forced to exit the screen means (300) via apertures (320). The screen member (330) comprises a cross-sectional profile typically similar to, but of smaller geometric area than, that of the housing (200) at corresponding positions along the longitudinal axes thereof. In other words, the said screen member (330) comprises a cross-section which, with respect to a corresponding cross-section of said air intake duct (60), decreases in area in a downstream direction. Thus, in the preferred embodiment shown the Figures, the screen member (330) comprises a sheet-like construction having generally rectangular cross-sectional profile along its length, and having trapezoidal upper, lower and left-side and right-side walls (382), (384), (386) and (388), respectively, each said wall (382), (384), (386) and (388) comprising parallel long upstream and short downstream sides, joined by symmetrical angled sides. Adjacent said walls (382), (384), (386) and (388) are Joined together along facing angled sides thereof. The short downstream ends of said walls (382), (384), (386) and (388), are joined to the periphery of said downstream end (340) of the screen means (300). Preferably, the said screen means (300), and at least the said screen member (330), is an integral component, preferably made from a heat-conducting material, and is optionally fabricated from thin copper or brass sheeting preferably coated with a nickel-chromium alloy. The walls (382), (384), (386) and (388) are typically between 0.5 mm and about 2 mm, and preferably about 1 mm, but may be thinner than 0.5 mm or thicker than 2 mm, as required.

Thus, in the preferred embodiment, the upstream end (310) of the screen means (300) is sealingly joined to the upstream end (205) of the housing (200). The screen member (330) is progressively spaced away from corresponding internal walls (210) of the housing, (200) in a downstream direction, offering a correspondingly Increasing axial flow area for the air/fuel mixture as it passes through the apertures (320), thus maintaining the axial velocity of the air-fuel mixture more or less the same as without the screen member (330) in the air intake duct (60). Since the downstream end (340) of the screen means (300) is closed the air/fuel mixture must go through the apertures (330) at an angle to the axis of the housing (200), typically of between about 30° and about 90°. Further, the close proximity of the apertures (320) to the internal surface (210) at the upstream end of the housing (200), and their gradual distancing therefrom in a downstream direction results in the air-fuel mixture being urged into a trajectory more-or-less parallel to the internal surface (210) after the mixture emerges from successive rows of the plurality of apertures (320) of the screen member (330). This ensures that any fuel droplets carried by the airflow are in tangential, thermal contact with the internal surface (210) for a relatively long time. This action is in fact helped by the presence of a friction-reducing coating or layer such as Teflon, as discussed above. The result is that a relatively large proportion of the fuel that is still in droplet form is vaporised due to the heat of the engine block (during running of the engine) carried by the walls of the air intake duct (60), and thus transmitted to the housing (200) by conduction.

Optionally, the screen means (300) further comprises ribs or primary axial vanes (360) extending from the screen member (330) to the inner surface (210) of housing (200) in a longitudinal direction. The primary vanes (360) act as struts to maintain the mechanical integrity and position of the screen member (330) in housing (200), but also divide the air/fuel flow into a number of separate channels to reduce the possibility of fuel droplets coagulating into larger droplets. The primary vanes (360) are also preferably made from copper or brass coated with nickel-chromium alloy, or other suitable heat conducting material thereby adding heat-exchange surface area for further vaporising fuel droplets that are brought into contact therewith. In the preferred embodiment shown in the Figures, four primary vanes (360) are comprised on the screen member (330) joined to the vertices formed between adjoining said walls (382), (384), (386) and (388), and to corresponding vertices in said housing (200).

The said screen means (300) further optionally comprises at least one, alternatively a plurality and preferably a pair of secondary vanes (370) arranged transversely between at least one, and preferably each, adjacent pair of said primary vanes (360) Said secondary vanes (370) further improve the mechanical integrity of the screen member (330), and particularly contribute to the stiffness of each corresponding wall (382), (384), (386) and (388) to which they are joined, preferably integrally, at the leading edges thereof. Further, said secondary vanes (370) provide swept-back angled surfaces to further direct the air-fuel mixture towards the inner surface (210) as it exits apertures (320) upstream of the secondary vanes (370).

The said screen member (330) comprises a plurality of outlet perforations or apertures (320) for providing fluid communication between the upstream end of the air inlet system including the intake manifold (66), and the downstream end (68) of the air intake duct (60). The apertures (320) are generally small, typically from about 1 mm to about 3 mm diameter, and preferably about 2 mm, and are disposed on the screen member (330) to provide together a total geometric flow area about 25% to about 75%, and preferably about 50% greater than upstream inlet cross-sectional or geometric flow area of the screen means (300), i.e., effectively of the inlet of said air intake duct (60) Of course, the total geometric area provided by the apertures (320) may be increased or decreased from these values by respectively increasing or decreasing the number of apertures (320), for example The apertures (320) are adapted for enhancing atomisation of liquid fuel passing therethrough: liquid droplets passing through the apertures (320) are mechanically broken up into even smaller droplets by impact with the screen solid area (325) as well as by the turbulence created on the downstream side of the screen member (330).

Figure 2:
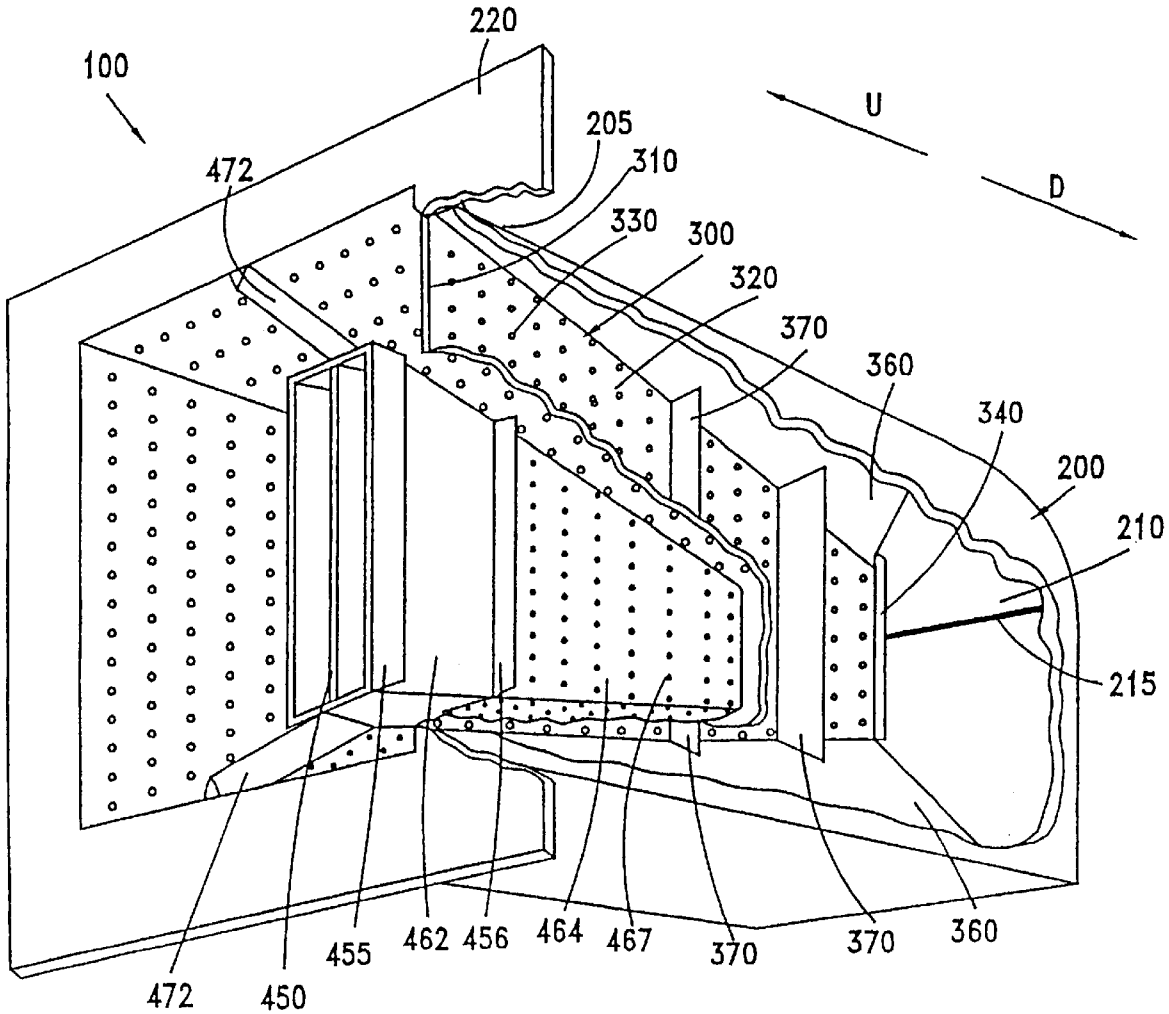
FIG. 2 illustrates in downstream perspective partial cutaway view the main elements of the preferred embodiment of the present invention.
Figure 3:
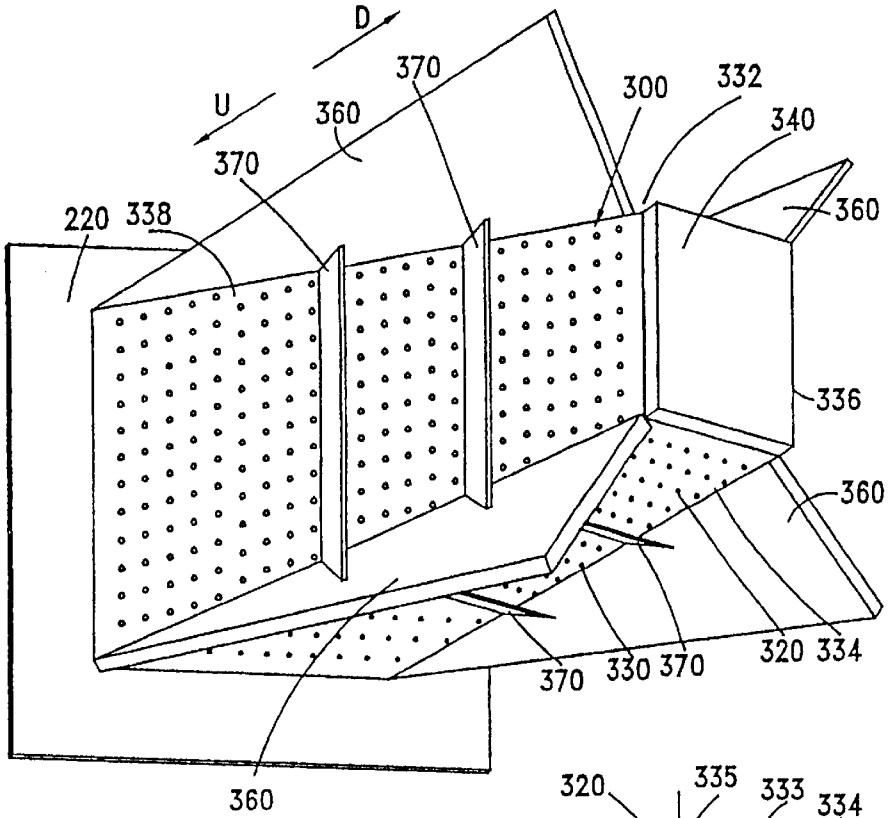
FIG. 3 illustrates in upstream perspective view the embodiment of FIG. 2 without the housing.
Figure 4:
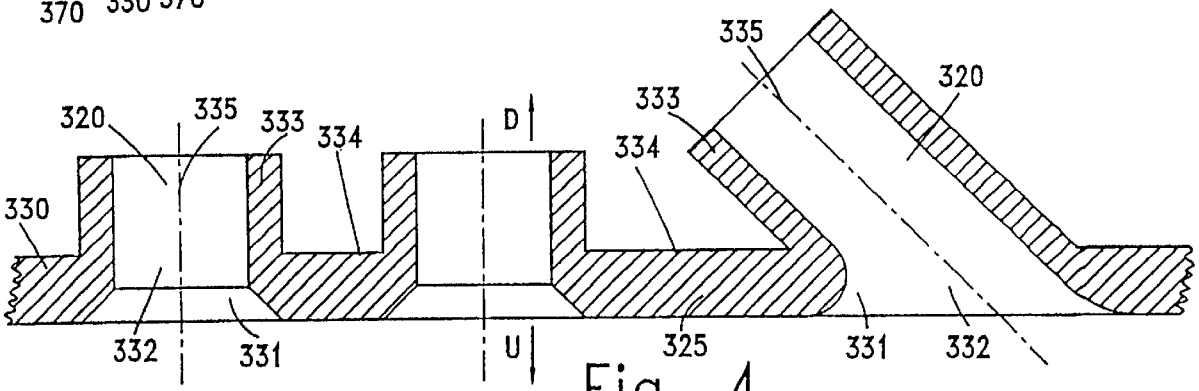
FIG. 4 illustrates a cross-section of the screen member of the present invention.
Figure 7:
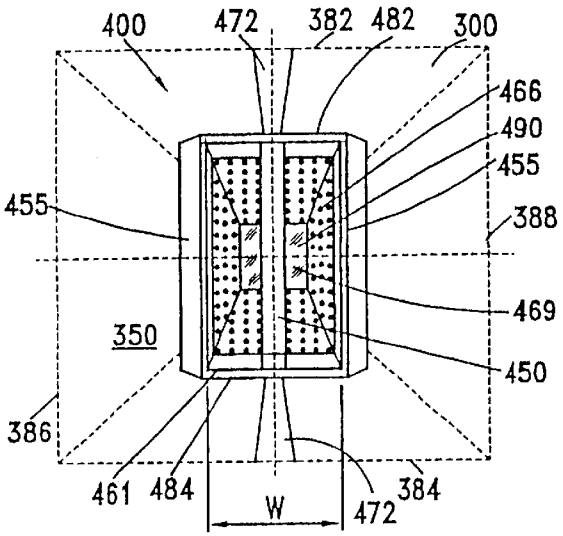
FIG. 7 illustrates a downstream view of the embodiments of FIGS. 5 and 6.

Thus, the screen member (330) may comprise a weave-like construction such as a mesh or net, in which the apertures (320) are formed as openings between the warp elements and the weft elements thereof in the preferred embodiment, the screen member (330) comprises a thin sheet construction comprising a plurality of orifices (332), as illustrated in FIGS. 2 and 3, for example. These orifices (332) are preferably nozzle-like and optionally each have a bell-mount or beveled upstream entry (331), and an optional, preferably integral, downstream exit nozzle member (333) extending in a downstream direction from the downstream surface (334) of the screen member (330) The nozzle member (333) helps to accelerate the flow of air/fuel mixture, assisting in the atomisation of the fuel, and also helps direct the flow towards and along tie internal surface (210) In a downstream direction Typically, the orifices (332) are of circular cross-sectional profile, but may be of any other suitable cross-section, including oval, polygonal and so on, As illustrated in FIG. 4, the central axis (335) of some, and optionally all, of the orifices (332) may be approximately perpendicular to the plane of the screen member (330), and this is particularly convenient for manufacture thereof. Nevertheless, other variations are possible and indeed preferable in some cases. For example, at the upstream end of the screen member (330), the axes (335) of the orifices (332) may be approximately aligned with the longitudinal axis of the air intake duct (60) to urge the air-fuel mixture to flow along the internal surface (210) of the housing (200), and thus enable the fuel to be vaporised further as described hereinbefore, and this variation is also illustrated in FIG. 4. At the same time, at the downstream end of the screen member (330), the axes (335) of the orifices (332) may be approximately aligned at right angles to the longitudinal axis of the air intake duct (60), to provide a cross-flow and thus urge the air-fuel mixture emerging from these orifices (332) to be thoroughly mixed with air-fuel mixture originating from the upstream orifices (332).

The stream of air flowing through the intake manifold (65) and through the air intake duct (60) in conventional internal combustion engines tends to adopt a flow velocity profile such that the fuel droplets, which are injected into the intake manifold by means of fuel injector (70) or alternatively provided by means of a carburetor (19) or other fuel delivery system, and carried with the air stream, are urged to a central section of the intake manifold (65) and of the air intake duct (60), and away from its walls (66). In the present invention, the said screen means (300) is provided in the air intake duct (60) to essentially force the fuel droplets to be atomised and mixed with air by passing through apertures (320), and to maintain this state by extended thermal contact with the internal surface (66) of the air intake duct (60), optionally, and preferably, via housing (200), as discussed above. Thus, the screen means (300) has a more significant effect on peripheral parts of the air-fuel mixture flowing into the device (100) than on the central portion of the flow. By having a closed downstream end (340), the central portion of the air stream (comprising the majority of the fuel droplets) is forced to change direction from a predominantly longitudinal direction to transverse directions towards the screen member (330). However, this latter effect is most pronounced at the downstream end of the screen member (330), after impact of the fuel droplets with the closed end (340), and therefore there is little time for the fuel droplets emerging from the apertures (320) on the downstream end of the screen member (330) to be fully atomised and/or subsequently vaporised by thermal contact with said internal surface (66). Thus, while the screen means (300) provides and maintains a high level of fuel atomisation, vaporisation and uniform mixing of the fuel with air, further improvements are possible by vaporising the mainstream of fuel droplets carried by the air stream prior to being passed through apertures (320).

Thus, the said device (100) preferably optionally further comprises a vaporising means having at least one heat exchange surface in thermal communication with at least a portion of the air/fuel mixture. The vaporising means preferably comprises an upstream housing portion adapted to channel a portion of the air-fuel mixture towards and along said at least one heat exchange surface The upstream housing portion is preferably in fluid communication with a downstream housing portion, which comprising second screen means having suitable apertures for atomising fuel droplets and mixing same with air, and for providing fluid communication between the heat exchange surface and the outside of the second screen means, the second screen means having a closed downstream end.

Figure 9:
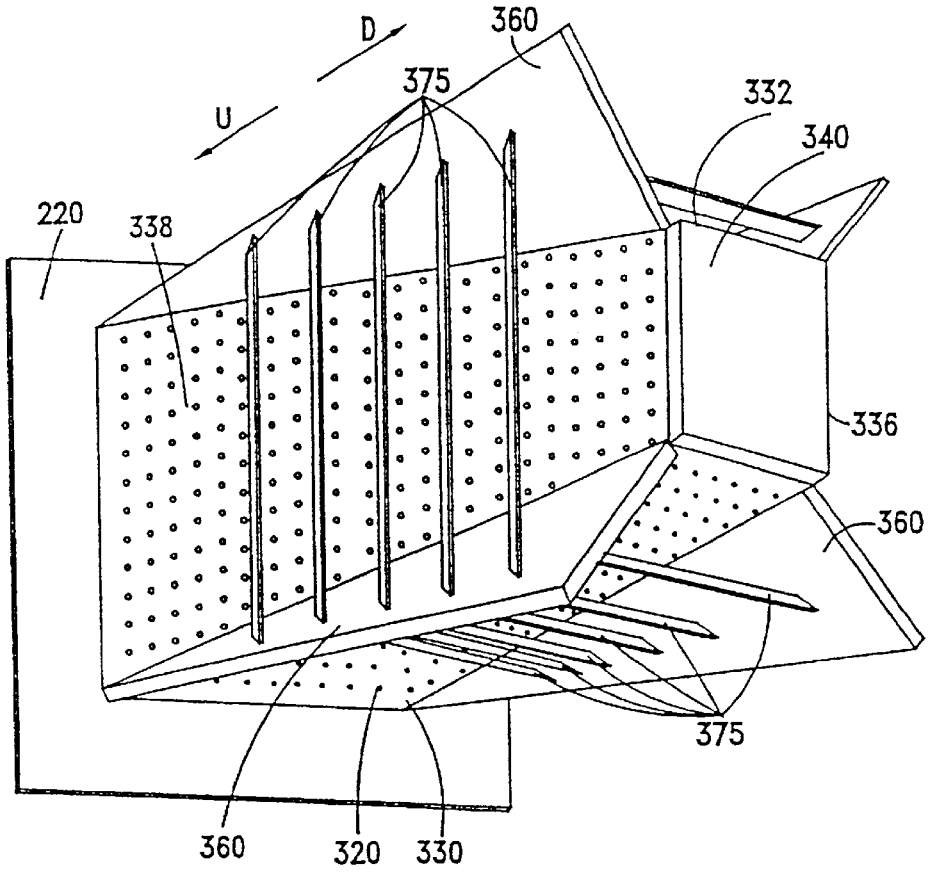
FIG. 9 illustrates in upstream perspective view the embodiment of FIG. 8 without the housing.

Thus, in the preferred embodiment, the said device (100) further comprises vaporising means (400) for vaporising fuel comprised in central portion of the fuel-air mixture flowing from the said intake manifold (65) into the device (100). Referring to FIGS. 9. 5, 6 and 7, said vaporising means (400) extends downstream into the said screen means (300) and comprises a heating means preferably in the form of an elongate electrical heating element (450) having substantially parallel heat exchange surfaces, (452), (454) respectively on opposite sides thereof. The heat exchange surfaces (452), (454) are substantially parallel to one another and are substantially aligned with the flow direction into the housing (200). In the preferred embodiment, the said heating element (450) is relatively thin in relation to the width of the housing (200), and heat exchange surfaces (452), (454) are vertically disposed within the housing (200), extending from its centre in an upwardly and downwardly direction to about 50%–75% of the height of the screen means (300). The heating element (450) is operatively connected to a suitable thermostat (490) preferably at the downstream end thereof, for regulating and controlling the temperature thereof The heating element (450) is accommodated in a substantially rectangular in housing (460) having an open upstream inlet end (461), and a closed downstream end (469). The inner housing (460) comprises an upstream section (462) extending downstream from the periphery of the inlet end (461) along approximately 25% to 50% of the longitudinal length of the inner housing (460). The upstream section (462) funnel the fuel-rich air/fuel mixture flowing substantially along the central axis of the screen means (300) towards and along the heating element (450) so that prolonged substantially tangential contact of fuel droplets with the said heat exchange surfaces, (452), (454) results in vaporisation of at least a proportion of the fuel droplets The upstream section (462) is in fluid communication with a downstream section (464) comprising a second screen member (466) extending between a periphery of said upstream section (462) and a periphery of said closed downstream end (469). The second screen member (466) comprises a plurality of outlet apertures (467) for providing fluid communication between the inner housing (460) and the downstream end of the screen means (300). As the fuel-rich air-fuel mixture flows inside the said inner housing (460), fuel droplets are progressively vaporised by prolonged thermal contact with said heat exchange surfaces (452), (454), and the said apertures (467)

provide further atomisation and mixing of fuel passing therethrough with the air-fuel mixture flowing in the space (350) between the screen means (300) and the inner housing (460).

The upstream portion (461) is adapted for channeling the fluid flow from the intake manifold, consisting of air with fuel in die form of vapour and droplets of varying sizes, into the volume bounded by the inner lousing (460) and the closed downstream end (469) so that the fluid flow is forced to exit the inner housing (460) via apertures (467). The inner housing (460) comprises a cross-sectional profile typically similar but narrower to that of the screen means (300) at corresponding positions along die longitudinal axes thereof. Thus, in the preferred embodiment shown the Figures, the inner housing (460) comprises a sheet-like construction having generally rectangular cross-sectional profile along its length, and having trapezoidal upper, lower and left-side and right-side walls. (482), (484), (486) and (488), respectively, each said wall. (482), (484), (486) and (488), each comprising parallel long upstream and short downstream sides, joined by symmetrical angled sides. Adjacent said walls (482), (484), (486) and (488) are joined together along facing angled sides thereof. The short downstream ends of said walls (482), (484), (486) and (488), are joined to the periphery of said closed downstream end (469) of the inner housing (460). Preferably, the said inner housing (460) is an integral component, preferably made from a heat-conducting material, and is optionally fabricated from thin copper or brass sheeting preferably coated with a nickel-chromium alloy. The walls (482), (484), (486) and (488) are typically between 0.5 mm and about 2 mm, and preferably about 1 mm, but may be thinner than 0.5 mm or thicker than 2 mm, as required.

Figure 5:
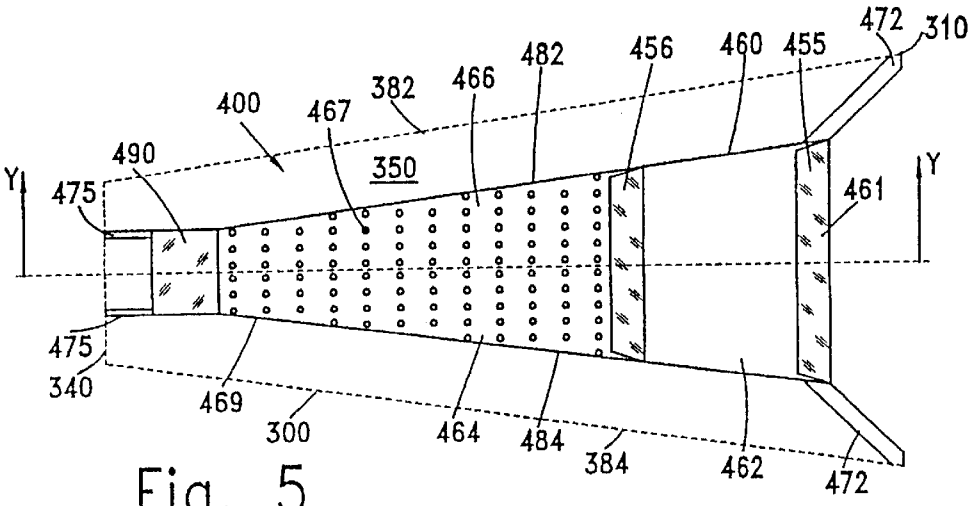
FIG. 5 illustrates in side view the vaporising means of the embodiment of FIG. 2.
Figure 6:
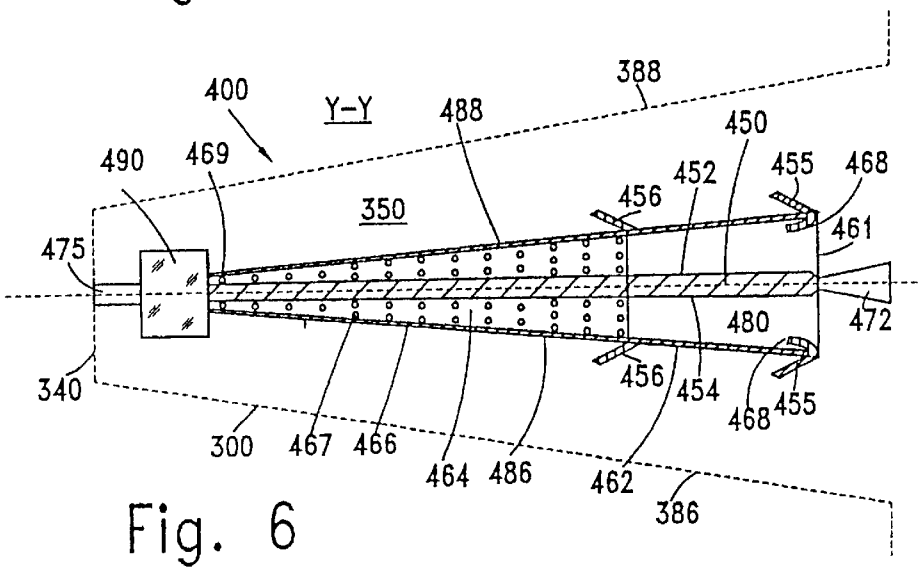
FIG. 6 illustrates in cross-sectional view the embodiment of FIG. 5 along Y—Y.

The inlet end (461) of the vaporising means (400) may be aligned with the inlet end (310) of the screen means (300), or may alternatively be displaced upstream with respect thereto. Preferably, and as shown in FIGS. 5 and 6 in particular, the inlet end (461) of the vaporising means (400) is displaced in a downstream direction with respect to the inlet end (310) of the screen means (300). The inlet area of said inlet end (461), represented by the width (w) between the side walls (486), (488) at the inlet end (461), particularly in relation to the inlet area of the inlet end (310) of the screen means (300) is an important parameter. If the area, or dimension (w), of the inlet end (461) is too small a proportion of the fuel rich central portion of the flow does not get channeled through the vaporising means (400), reducing the vaporising and mixing efficiency of the device (100). If the area, or dimension (w), of the inlet end (461) is too large, the fuel-rich central portion of the flow is not maintained in sufficient proximity to the heat exchange surfaces (452), (454), thereby reducing the vaporising efficiency of the device (100). As an optional feature, said inlet end (461) may comprise opposed inlet flaps (468) for directing the air-fuel mixture flowing through the vaporising means towards and along the heating element (450). Each flap (468) is cantilevered on the upstream edge of side walls (486), (488), illustrated in FIG. 6. By bending inwards or outwards one or both said flaps (468), the said width (w), and therefore area of said inlet end (461) may be respectively decreased or decreased within predetermined parameters.

In the preferred embodiment, the inner housing (460) is mounted within the said screen means (300) by any suitable mounting means including, for example, at least one of and preferably both upper and lower upstream struts (472) to the upstream end (205) of the housing (200) and/or to the upstream end (310) of the screen means (300). Optionally, the said inner housing (460) may be further secured in said screen means (300) by means of at least one and preferably two additional downstream struts (475) to the downstream end wall (340). The said walls (482), (484), (486) and (488) of said inner housing (460) are in substantially parallel and opposed relationship to corresponding walls said walls (382), (384), (386) and (388), respectively, of said screen member (330), said side walls (486) and (488) being relatively more distanced from side walls (386), (388), respectively, than upper and lower walls (482), (484) from upper and lower walls (382), (384), respectively. Since the downstream end (469) of the inner housing (460) is closed the fuel-rich air/fuel mixture must go through the apertures (467) and into the space (350) between the screen means (300) and the inner housing (460). The fuel air mixture in this space (350), arriving directly from the intake manifold (65) or indirectly via apertures (467) of the vaporising means (400), is then urged via apertures (320) towards the internal surface (210) at the upstream end of the housing (200). The gradual distancing of the apertures (320) from internal surface (210) in the downstream direction further results in the air-fuel mixture being urged into a trajectory more-or-less parallel to the internal surface (210) after the mixture emerges from successive rows of the plurality of apertures (320) of the screen member (330). As before, thus ensures that any fuel droplets carried by the airflow are in substantially tangential, thermal contact with the internal surface (210) for a relatively long time. This action is in fact helped by the presence of a friction-reducing coating or layer such as Teflon, as discussed above. The result is that most if not all of the fuel is fully vaporised and well mixed with air just upstream of the entry port (62) of the cylinder (10), after passing through device (100).

Optionally, the inner housing (460) further comprises vanes (455), (456) arranged transversely on the upstream and downstream ends, respectively, of said upstream portion (462), on each of the side walls (486), (488). Said vanes (455), (456) further improve the mechanical integrity of the inner housing (460), and particularly contributes to the stiffness of side walls (486) and (488) to which they are joined, preferably integrally, at the leading edges thereof Further, said vanes (455), (456) provide swept-back angled surfaces to further direct the air-fuel mixture towards the screen member (330) as it flows in the space between the screen means (300) and the inner housing (460).

The said downstream end (464) of said inner housing (460) comprises a second screen member (466) having a plurality of outlet perforations or apertures (467) for providing fluid communication between the internal space (480) enclosed by said inner housing (460) and the space (350) between the said vaporising means (400) and screen member (330). The apertures (467) are generally smaller than apertures (320) of screen member (330), the former being typically from about 0.5 mm to about 2.5 mm diameter, and preferably about 1.5 mm, and are disposed on the downstream portion (464) of inner housing (460) to provide together a total geometric flow area about 50% greater than upstream inlet cross-sectional area of the inner housing (460). Of course, the total geometric area provided by the apertures (467) may be increased or decreased from this value by respectively increasing or decreasing the number of apertures (467), for example The apertures (467) are adapted for enhancing atomisation of liquid fuel passing therethrough: any liquid fuel droplets passing through the apertures (467) are mechanically broken tip into even smaller droplets by impact with die solid portions of the said second screen member (466) as well as by the turbulence created on the downstream side of the second screen member (466).

As with the said first screen member (330), the second screen member (466) may also comprise a weave-like construction such as a mesh or net, in which the apertures (467) are formed as openings between the warp elements and the weft elements thereof. In the preferred embodiment, the second screen member (467) comprises a thin sheet construction comprising a plurality of orifices preferably similar to orifices (332) of screen member (330) as described above and illustrated in FIG. 4, mutatis mutandis.

The preferred embodiment of the present invention may be used with internal combustion engines comprising carburetors or fuel injection systems of all types, and particularly for fuel injection engines operating at rpm's greater than about 2500–2000 rpm, with or without supercharging or turbocharging. However, fuel injected engines operating at rpm's lower than about 2500–2000 rpm, or engines comprising carburetors may be equipped with a simpler form of the device (100) according to the second embodiment of the present invention, for example, as described hereinbelow.

Figure 8:
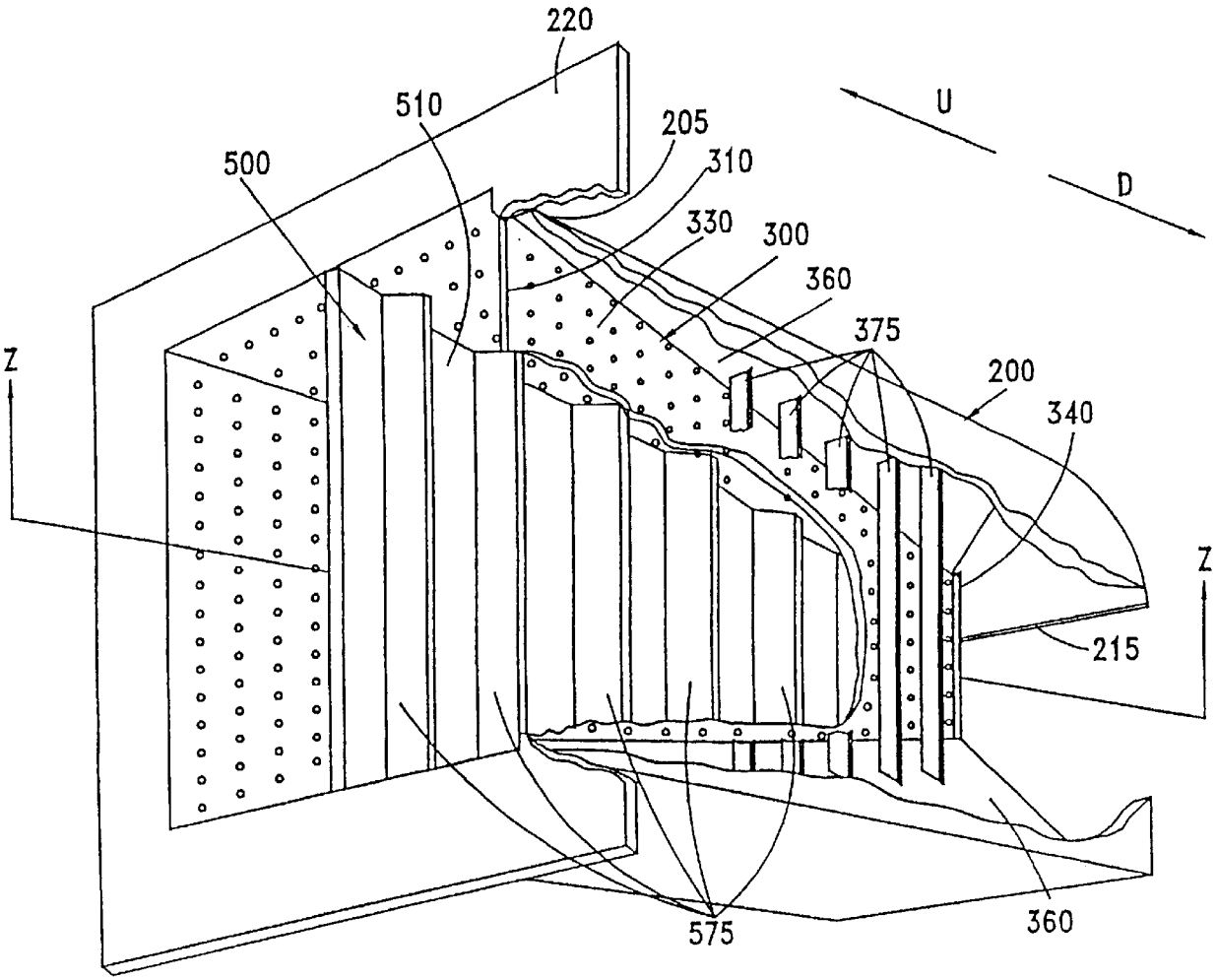
FIG. 8 illustrates in downstream perspective partial cutaway view the main elements of the second embodiment of the present invention.
Figure 10:
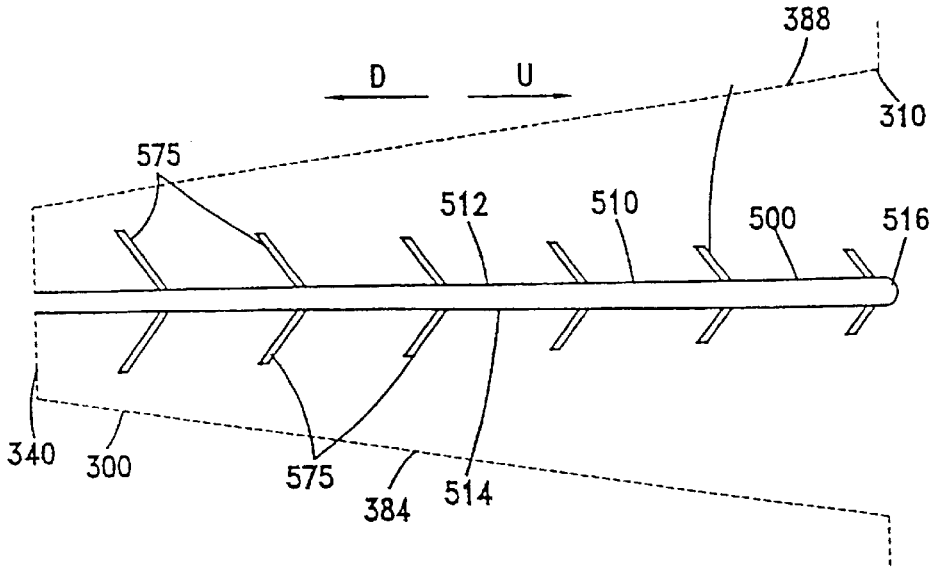
FIG. 10 illustrates in cross-sectional view the embodiment of FIG. 8 along Z—Z.

A second embodiment of the present invention, illustrated in FIGS. 8, 9, 10 (and 4), comprises the same structural elements as the preferred embodiment, with the exception of the said vaporising means (400) (including said heating element (450), said inner housing (460), said struts (472) and (475), said vanes (455), (456), or thermostat (490)) and of said secondary vanes (370), substantially as hereinbefore described, mutatis mutandis.

In the second embodiment of the present invention, the device (100) further optionally comprises internal turning means (500) for directing the flow entering the screen means (300) towards the walls (382), (384), (386) and (388) of said screen member (330), and thus through apertures (320). In this embodiment said turning means (500) may comprise a splitter wall (510) having a leading edge (516) and substantially vertical surfaces (512), (514) extending downstream and running the axial length of the screen means (300) from the inlet end (310) to the closed end (340), and joining the upper wall (382) to the lower wail (384) at their respective mid-sections. The splitter wall (510) further optionally comprises a plurality of primary turning vanes (575) in parallel transverse arrangement on each said surface (512), (514). Preferably, the axial length of said plurality of said primary turning vanes (575) on each surface (512), (514) is progressively longer for the downstream vanes (575) than for the upstream vanes (575). Said primary turning vanes (575) further improve the mechanical integrity of the screen member (330), and particularly contribute to the stiffness of tie upper wall (382) and the lower wall (384) to which they are joined, preferably integrally. Primarily, said primary turning vanes (575) provide a cascade of swept-back angled surfaces distanced from each corresponding surface (512), (514) to further direct the air-fuel mixture towards the screen member (330) and thus apertures (320).

In the second embodiment of the present invention, the said screen means (300) further optionally comprises a plurality of secondary turning vanes (375) in parallel transverse arrangement between adjacent said primary vanes (360). The secondary turning vanes (375) are laterally displaced at corresponding leading edges thereof from a corresponding one of said wall (382), (384), (386) and (388). Said secondary turning vanes (375) further improve the mechanical integrity of the screen means (300) as a whole, and are joined at their ends, preferably integrally with, facing solaces of adjacent said primary vanes (360). Primarily, said secondary turning vanes (375) provide a cascade of swept-back angled surfaces distanced from each corresponding wall (382), (384), (386) and (388) to further direct the air-fuel mixture towards the inner surface (210) as it exits apertures (320) upstream of the secondary turning vanes (375).

Optionally, and in a second aspect of the present invention, the engine (1) comprising said device (100) for at least one cylinder (10) thereof may further comprise combustion stability means (900) for delivering an atomised medium (950) to the combustion chamber (22) during the induction stroke. Said medium (950) generally comprises a mixture of methanol or the like and acetic acid or the like, in about equal proportions by volume, said acetic acid being typically in a concentration of about 5% acetic acid/95% water by volume. Said medium (950) is provided for minimizing probability of pre-ignition of the air fuel mixture and for cleaning the intake duct (60) and exhaust duct (30) of the engine (1) as well as the combustion chamber (22) during normal running of the engine (1).

Figure 12:
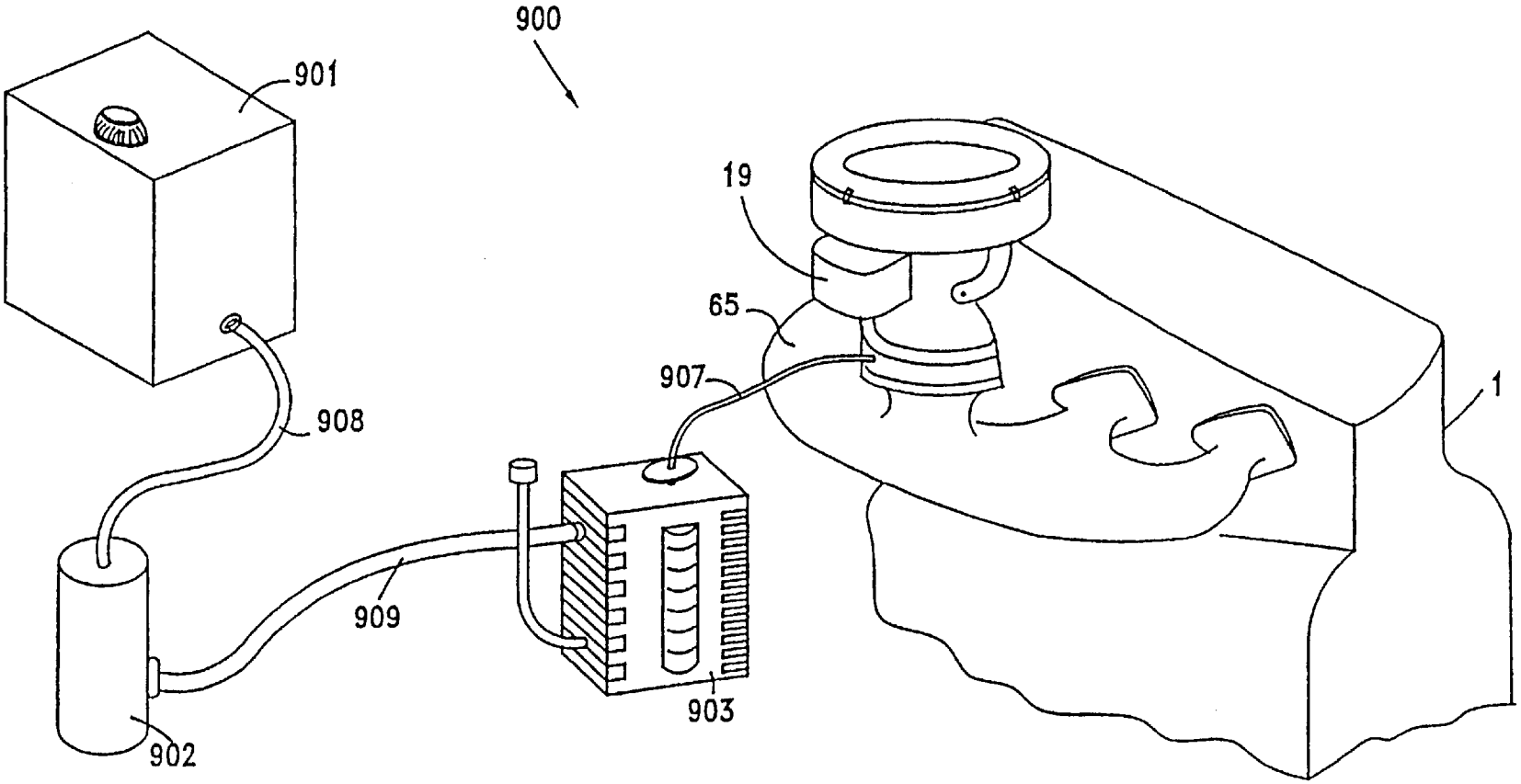
FIG. 12 schematically illustrates a preferred embodiment of the combustion stability means of the present invention.
Figure 13:
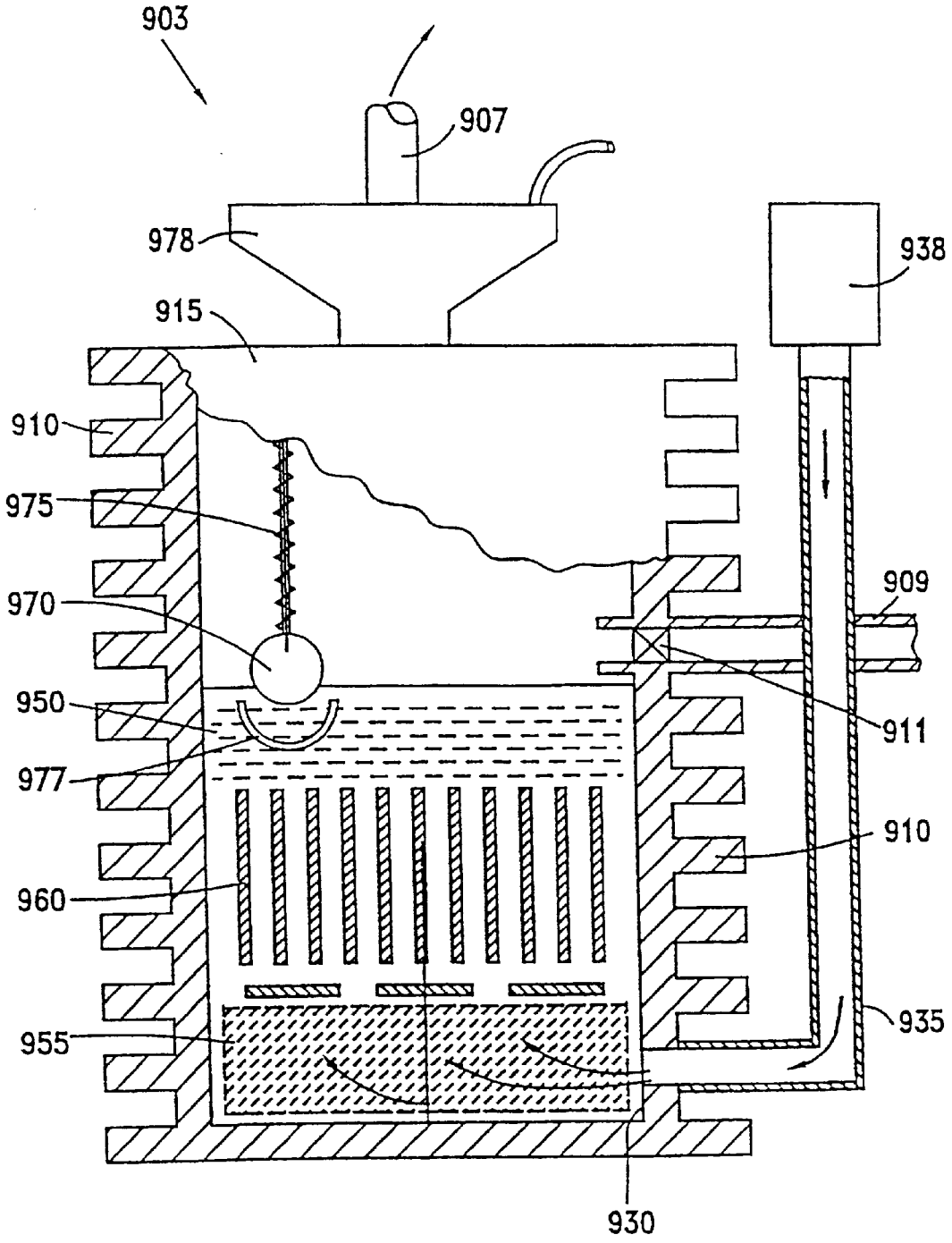
FIG. 13 illustrates in partially sectioned side view the atomiser of FIG. 12.
Figure 14:
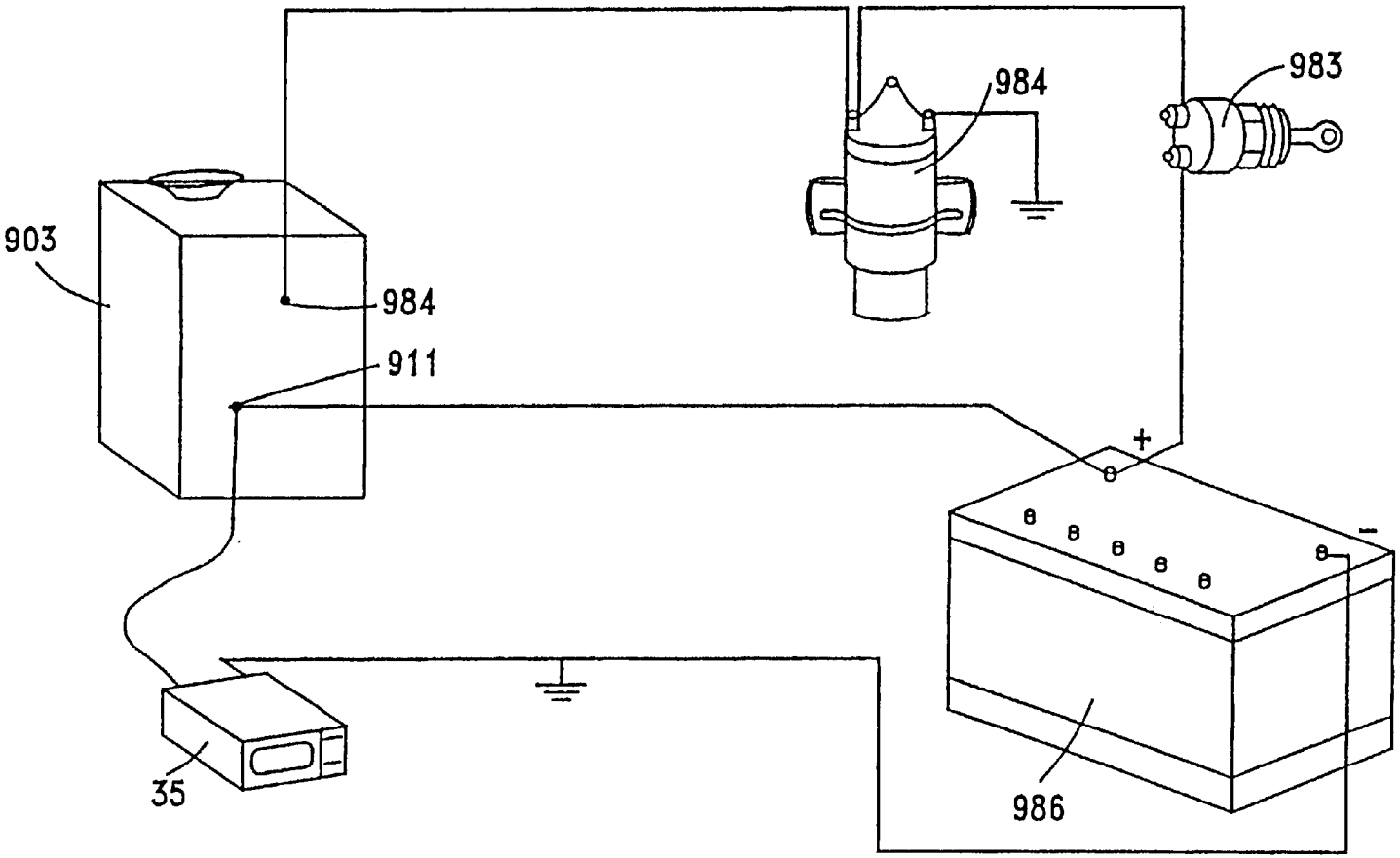
FIG. 14 schematically illustrates control means for the atomiser of FIGS. 12 and 13.

Referring to FIGS. 12, 13 and 14, a preferred embodiment of said combustion stability means (900) comprises a refillable reservoir (901) for holding a suitable volume of said medium (950) and for supplying the same to an atomising unit (903) via lines (908), (909) and filter (902).

The atomiser (903) is provided for breaking up, atomising and aerating the said medium (950). The atomiser (903) is typically mounted close or onto the engine (1) in order to maximize heat transfer to the atomiser (903) via heat exchange vanes (910) comprised on the outer case (915) thereof.

Air is supplied to the bottom end (930) of the said atomiser (903) via filter (938) and inlet pipe (935), and through an aerator (955) for aerating the medium (950). Internal heat exchange vanes (960) heat up the medium (950) and enable the medium to be at least partially vaporised. Vaporised and aerated medium (950) is collected in the upper space or volume of the atomiser (903), and then siphoned off to the engine air intake system via adjustable vacuum pump (978) and line (907) The atomiser (903) is kept supplied with medium (950) via line (909) and automatic filler means (911), typically an electrically controlled valve, which responds to a drop in level of the medium (950) detected by suitable level detector, comprising for example an arrangement including a float (970) and solenoid (975). A guard (977) prevents excessive limitation of the float (975) within the atomiser (903).

Referring to FIG. 14, the atomiser may be controlled by means of ignition lock (983), ignition coil (984), automatic filler means (911) and relay (not shown), a storage battery (986) and an optional display device (987). In order to bring the device into operating condition, the imitation is switched on and voltage applied to the coil (984) and relay, which in turn actuates the filler means (911) to feed medium (950) from tank (901), and air via the line (935). As medium is vaporised, aerated and supplied to the engine (1), the level of medium (950) drops within the atomiser (903), and the float (970) coupled to the solenoid (975) detects the drop and sends a signal to the filler means (911) to provide more medium (950). The visual display (35) displays the overall operation of the atomiser (903).

The output line (907) may be operatively connected to a carburetor (19) of an engine (1) if so fitted. Alternatively, where the engine (1) is fitted with a fuel injection system, the output line (907) is operatively connected to a distributor

(64) typically inside the manifold (65) as illustrated in FIG. 11 (or alternatively outside same) by means of a flange (18) having an upstream opening (17). Thus, aerated medium (950) can be fed from the atomiser (903) via distributor (64) to a set of porous nozzles (15), for breaking up particles of medium even further. The nozzles (15) may typically be made from porous bronze or special plastic.

While in the foregoing description describes in detail only a few specific embodiments of the invention, it will be understood by those skilled in the art that the invention is not limited thereto and that other variations in form and details may be possible without departing from the scope and spirit of the invention herein disclosed.

What is claimed is:

1. A fuel-air mixing device for installation in an air intake system of an internal combustion engine, said device comprising:

first screen means having an open upstream inlet end, a closed downstream end, and a screen extending between a periphery of said upstream end and a periphery of said downstream end and comprising a plurality of outlet apertures for providing fluid communication between an upstream end of the air intake system and a downstream end thereof, said apertures adapted for enhancing atomization of liquid fuel passing therethrough;

mounting means for mounting said screen means within said air intake system;

said device characterized in being adapted for installation in an air inlet duct of the intake system, said air inlet duct being adjacent to a combustion chamber of a cylinder of said internal combustion engine, such that said device extends towards a downstream end of said air inlet duct just upstream of an air inlet port of the combustion chamber, wherein a fuel-air mixture resulting from flowing through the device has relatively little time to form droplets or for such droplets to coalesce into larger particles or to be urged to a center of the inlet port; and wherein said first screen means further comprises a plurality of primary axial support vanes extending from said screen member in an outward and longitudinal direction.

2. A fuel-air mixing device as claimed in claim 1, wherein at least some of said plurality of apertures are further adapted to direct fluid passing therethrough in a substantially downstream direction towards and substantially parallel to internal walls of said air inlet duct opposite said apertures.

3. A fuel-air mixing device as claimed in claim 1, wherein said apertures are substantially circular.

4. A fuel-air mixing device as claimed in claim 1, wherein said apertures are substantially nozzle-like each comprising a downstream outlet end.

5. A fuel-air mixing device as claimed in claim 1, wherein said closed downstream end of said first screen means is substantially perpendicular to a longitudinal axis of said air inlet duct.

6. A fuel-air mixing device as claimed in claim 3, wherein said apertures of said first screen means each comprise a diameter of between about 1 mm and about 3 mm.

7. A fuel-air mixing device as claimed in claim 1, wherein said plurality of apertures provide a combined geometric flow area of between about 25% and about 75% of a geometric inlet flow area of the said first screen means.

8. A fuel-air mixing device as claimed in claim 1, wherein said mounting means comprises a flange joined to said upstream end of said screen means and adapted for being seated intermediate said air inlet duct and an intake manifold of said air intake system directly or via one or more gaskets.

9. A fuel-air mixing device as claimed in claim 1, further comprising a housing axially enclosing said first screen means and having an external profile substantially complementary to an inside surface of at least a portion of the said air inlet duct extending downstream from an inlet thereof which enables said housing to be mounted into said air inlet duct in a tight fitting manner.

10. A fuel-air mixing device are claimed in claim 9, wherein said first screen means comprises an internal surface which substantially replaces a corresponding portion of said internal surface of said air inlet duct as the fluid flow boundary.

11. A fuel-air mixing device as claimed in claim 10 wherein said internal surface of said housing comprises a coating or layer of lubricating material.

12. A fuel-air mixing device as claimed in claim 11, wherein said lubricating material is Teflon.

13. A fuel-air mixing device as claimed in claim 9, wherein the said screen member comprises a cross-section which, with respect to a corresponding cross-section of said a inlet duct, decreases in area in a downstream direction.

14. A fuel-air mixing device as claimed in claim 13, wherein said cross-section of said screen member is substantially rectangular.

15. A fuel-air mixing device as claimed in claim 14, wherein said screen member comprises trapezoidal upper, lower and left-side and right-side walls, each said wall comprising parallel long upstream and short downstream sides, joined by symmetrical angled sides, wherein adjacent said walls are joined together along facing angled sides thereof.

16. A fuel-air mixing device as claimed in claim 15, wherein the said short downstream ends of said walls are joined to said periphery of said downstream end of the first screen means.

17. A fuel-air mixing device as claimed in claim 16, wherein said first screen means, and at least the said screen member, is an integral component.

18. A fuel-air mixing device as claimed in claim 17, wherein said first screen means, and at least the said screen member, is fabricated from thin copper or brass sheeting coated with a nickel-chromium alloy.

19. A fuel-air mixing device as claimed in claim 10, wherein said axial support vanes extend from said screen member to said inner surface of said housing in a longitudinal direction.

20. A fuel-air mixing device as claimed in claim 19, wherein said screen member comprises four said primary vanes joined to vertices formed between adjoining said walls of said screen member and to corresponding vertices in said housing.

21. A fuel-air mixing device as claimed in claim 20, wherein said screen member further comprises a plurality of secondary vanes arranged transversely between at least one pair of adjacent said primary vanes.

22. A fuel-air mixing device as claimed in claim 21, wherein said secondary vanes are joined at corresponding leading edges thereof to a corresponding said wall of said screen member.

23. A fuel-air mixing device as claimed in claim 22, further comprising suitable vaporising means comprising at least one having at least one heat exchange surface in thermal communication with at least a portion of a fuel-air mixing flowing through said device.

24. A fuel-air mixing device as claimed in claim 23, wherein said at least one heat exchange surface extends into said first screen means in a downstream longitudinal direction.

25. A fuel-air mixing device as claimed in claim 24, wherein said vaporising means comprises an upstream housing portion adapted to channel a portion of a fuel-air mixing flowing through said device towards and along said at least one heat exchange surface.

26. A fuel-air mixing device as claimed in claim 25, wherein said vaporising means further comprises a downstream housing portion comprising second first screen means having suitable apertures adapted for enhancing atomisation of liquid fuel passing therethrough and mixing thereof with an air stream.

27. A fuel-air mixing device as claim in claim 26, wherein said apertures of said second screen means each comprise a diameter of between about 0.5 mm and about 2.5 mm.

28. A fuel-air mixing device as claimed in claim 26, wherein said second screen means comprises a closed downstream end.

29. A fuel-air mixing device as claimed in claim 23, wherein said at least one heating element comprises an elongate electrical heating element having substantially parallel said heat exchange surfaces on opposite sides thereof.

30. A fuel-air mixing device as claimed in claim 29, further comprising a suitable thermostat means operatively connected to said heating element for controlling the temperature thereof.

31. A fuel-air mixing device as claimed in claim 30, wherein said vaporising means comprising suitable mounting means for mounting said vaporising means within said first screen means.

32. A fuel-air mixing device as claimed in claim 31, wherein said mounting means comprises at least one suitable strut joining an upstream end of said vaporising means to said inlet end of said fist screen means.

33. A fuel-air mixing device as claimed in claim 32, wherein said mounting means further comprises at least one suitable joining said downstream end of said vaporising means to said closed downstream end of said first screen means.

34. A fuel-air mixing device as claimed in claim 30, further comprising flaps on the upstream end of said vaporising means for directing an air-fuel mixture flowing through said vaporising means towards and along said heating element.

35. A fuel-air mixing device as claimed in claim 21, wherein said secondary vanes are laterally displaced at corresponding leading edges thereof from a corresponding said wall of said screen member.

36. A fuel-air mixing device as claimed in claim 35, further comprising internal turning means for directing an air-fuel mixture flowing in said device towards said walls of said screen member.

37. A fuel-air mixing device as claimed in claim 36, wherein said turning means comprises a splitter wall having an upstream leading edge and substantially vertical surfaces extending downstream into said first screen means.

38. A fuel-air mixing device as claimed in claim 37, wherein said splitter wall runs substantially the axial length of said first screen means from said inlet end to said closed downstream end of said first screen means, and joins said upper wall to said lower wall of said screen member at their respective mid-sections.

39. A fuel-air mixing device as claimed in claim 38, wherein said splitter wall further comprises a plurality of primary turning vanes on each said vertical surface thereof.

40. A fuel-air mixing device as claimed in claim 39, wherein said primary turning vanes provide a corresponding plurality of swept-back angled surfaces along each one of said vertical surfaces.

41. An internal combustion engine comprising said fuel-air mixing device as claimed in claim 1, installed in the air intake system of at least one cylinder thereof.

42. An internal combustion engine comprising said fuel-air mixing device as claimed in claim 1, installed in the air intake system of at least one cylinder thereof, further comprising combustion stability means for delivering an atomised medium to a combustion chamber comprised in said engine, said combustion stability means comprising:

a refillable reservoir for holding a volume of said medium;

an atomising unit;

suitable first and second fluid lines for respectively providing fluid communication between said reservoir and said atomising unit, and between said atomising unit and said intake system of said engine.

43. A combustion stability means as claimed in claim 42, further comprising a suitable filter in said first fluid line.

44. A combustion stability means as claimed in claim 43, wherein said atomising unit comprises a housing having air inlet means at a bottom side thereof, an aerator for aerating said medium, internal heat exchange vanes for heating said medium, an upper collection volume for collecting aerated vaporised medium, and outlet means in fluid communication with said engine intake system via said second fluid line.

45. A combustion stability means as claimed in claim 44, wherein air is provided to said air inlet means via a suitable air pipe in communication with a suitable air filter.

46. A combustion stability means as claimed in claim 44, further comprising automatic filler means operatively connected to a suitable level detector for maintaining the level of medium in said atomising unit.

47. A combustion stability means as claimed in claim 44, wherein said housing comprises external heat exchange vanes for absorbing external heat.

48. A combustion stability means as claimed in claim 47, wherein said medium comprises a mixture of methanol and acetic acid.

49. A combustion stability means as claimed in claim 48, wherein said mixture comprises about 50% methanol and about 50% acetic acid by volume.

* * * * *

UNITED STATES PATENT AND TRADEMARK OFFICE

CERTIFICATE OF CORRECTION

PATENT NO. : 6,612,295 B2
DATED : September 2, 2003
INVENTOR(S) : Moshe Lerner

It is certified that error appears in the above-identified patent and that said Letters Patent is hereby corrected as shown below:

Column 17,
Line 37, change "said inlet end of said fist screen means." to -- said inlet end of said first screen means. --

Signed and Sealed this

Second Day of March, 2004

JON W. DUDAS
*Acting Director of the United States Patent and Trademark Office*